US005662329A

United States Patent [19]

Nason

[11] Patent Number: 5,662,329

[45] Date of Patent: Sep. 2, 1997

[54] CHESS-TYPE GAME

[76] Inventor: Richard L. Nason, 4934 Ashelford Dr., Byron, Ill. 61010

[21] Appl. No.: 681,036

[22] Filed: Jul. 22, 1996

[51] Int. Cl.[6] ..... A63F 3/02

[52] U.S. Cl. ..... 273/261

[58] Field of Search ..... 273/260, 261, 273/283, 284, 287

[56] References Cited

U.S. PATENT DOCUMENTS

| | | | |
|---|---|---|---|
| 3,656,756 | 4/1972 | Gribbon, Jr. . | |
| 3,700,242 | 10/1972 | Sterler . | |
| 3,730,527 | 5/1973 | Nelson . | |
| 3,767,201 | 10/1973 | Harper et al. . | |
| 3,794,326 | 2/1974 | Bialek | 273/260 |
| 3,806,125 | 4/1974 | Bialek | 273/260 |
| 4,099,723 | 7/1978 | Robinson | 273/284 X |
| 4,179,127 | 12/1979 | Goodman | 273/260 X |
| 4,927,157 | 5/1990 | Rühiluoma et al. | 273/260 |
| 5,048,840 | 9/1991 | Johnson, Jr. | 273/283 X |
| 5,125,666 | 6/1992 | Adams . | |
| 5,158,302 | 10/1992 | Rewega . | |
| 5,209,488 | 5/1993 | Kimball . | |
| 5,338,040 | 8/1994 | Cutler | 273/261 X |
| 5,358,252 | 10/1994 | Mc Paul | 273/287 X |
| 5,456,472 | 10/1995 | Goodman | 273/260 X |
| 5,492,332 | 2/1996 | Hessnice . | |
| 5,509,662 | 4/1996 | Santianni . | |
| 5,556,099 | 9/1996 | Mardirosian | 273/261 X |

FOREIGN PATENT DOCUMENTS

| | | | |
|---|---|---|---|
| 3818343 | 12/1987 | Germany | 273/261 |
| 1703150 | 1/1992 | U.S.S.R. | 273/260 |

OTHER PUBLICATIONS

"Grand Chess", *Games Magazine,* Jan., 1987, p. 44.

*Primary Examiner*—William E. Stoll
*Attorney, Agent, or Firm*—Leydig, Voit & Mayer

[57] ABSTRACT

A chess-type board game uses a three-dimensional game board and has two new types of playing pieces. The game board has a right square pyramidal shape with six levels forming stepped sided and a flat top. The game board is divided into a 12-by-12 matrix of playing spaces. One of the new types of playing pieces is a catapult playing piece which is stationary on a corner playing space on the lowest level of the board, and guards selected playing spaces on the lowest level and selected playing spaces along a diagonal line of the board. The other new type of playing piece is a mace playing piece which may move between adjacent levels and may jump over other playing pieces of the same player when moving on a given level. The game can be played by two, three, or four players.

8 Claims, 5 Drawing Sheets

CHESS-TYPE GAME

FIELD OF THE INVENTION

This invention relates generally to board games, and more particularly to chess-type board games.

BACKGROUND OF THE INVENTION

The game of chess is one of the most popular board games. Typically the game is played on a flat, square, board divided into a plurality of square playing spaces in alternating colors. As a traditional game, the configuration of the game board of chess has not changed significantly over the years, and similarly the playing pieces and the rules governing their movement are basically the same as they were in the distant past. Although the traditional game of chess has been enjoyed by countless people, a substantial number of players enjoy new developments and variations to the game. In recent years, a variety of chess-type games have been introduced. Due to the divergent personal tastes of different players, however, the enthusiasm given to the chess-type games differs from player to player. A chess-type game may appeal to some players but not others. Likewise, some players may like certain aspects of a chess-type game but find other aspects of the same game unattractive.

For example, many chess-type games use reduced sets of playing pieces or smaller boards for the purpose of reducing the complexity of the game and the time required to finish the game, so that the game will be more attractive to beginners. One example is U.S. Pat. No. 4,927,157 to Riihiluoma, which discloses a chess-type game which uses a two-level game board. The game is significantly simplified as compared to the traditional game such that each player has only four playing pieces. Although the two-layered construction of the board is somewhat interesting because it adds some three-dimensional look to the game, the two levels are not well integrated in terms of the movement of playing pieces between the two levels. Some players may also consider the game to be overly simplified and therefore to have lost the flavor of the traditional chess game. Indeed, many experienced players find simplified chess-type games, or even the traditional chess game, not to be challenging enough, and would like to modify the chess game to make it more challenging and exciting to play.

Some modified chess games have been developed to address the unsatisfactory aspect of the traditional chess game that it can be played by only two players at a time, and other players who want to play have to wait for their own games. For example, U.S. Pat. No. 5,125,666 to Adams discloses a four-player board, and U.S. Pat. No. 5,209,488 to Kimball discloses a three-player board. The two games use flat, two dimensional boards which are variations of the traditional square board, with added sides to accommodate more than two sets of playing pieces. This multiple-player aspect is welcomed by players who often feel impatient to wait for their games. Many players also enjoy the challenge of playing against more than one opponent at the same time. The added sides on the modified boards, however, form disrupted peripheries which hinder the movement of the playing pieces.

Some modified games have added playing pieces not found in the traditional chess game. For example, U.S. Pat. No. 5,492,332 to Hessnice discloses a chess-type game which has a jester piece. The function of the jester piece is rather passive, and the addition of such a piece does not significantly change the nature of the game or transform the game to what might be considered another generation of chess.

SUMMARY OF THE INVENTION

In view of the foregoing, it is a general object of the present invention to provide a chess-type board game that modifies the traditional chess game in novel ways to significantly transform the traditional chess game into an improved game which provides enhanced fun, excitement, and challenge to players of the game.

A resultant object of the present invention is to provide a chess-type game with new playing pieces the addition of which significantly changes the game strategies so that the game retains the flavor of the traditional game while being more exciting and fun to play.

Another object of the present invention is to provide a chess-type game that uses a three-dimensional game board having a structure that imparts three-dimensional look and feel without hindering the smooth movement of the playing pieces.

It is a related object of the present invention to provide such a chess-type board game that can be played by two, three, or four players.

In accordance with theses and other objects of the invention, there is provided a new and improved chess-type board game for two or more players that uses a novel combination of a three-dimensional pyramidal game board and two new types of playing pieces. The game board has a right regular square pyramidal shape with four stepped sides and a flat top forming a plurality of levels of different heights. The levels are divided into a plurality of identifiable square playing spaces of alternating colors. The game apparatus includes two or more distinguishable sets of playing pieces, depending on the number of players playing the game. Each set includes selected playing pieces of the conventional chess game set, at least one catapult playing piece, and at least one mace piece.

Each catapult playing piece is positioned at a corner of the lowest level of the board and guards selected playing spaces on the lowest level and selected playing spaces located along a diagonal line across the game board. In the preferred implementation, in vertical projection the playing spaces form a square matrix with twelve file rows and twelve rank rows, and each catapult playing piece guards five playing squares in a rank row, five playing spaces in a file row, and six playing spaces in the diagonal direction.

The mace playing piece is capable of movement between adjacent levels and movement to other playing spaces on the same level. When the mace moves on its present level, it is permitted to jump over other playing pieces of the same set.

In accordance with the method aspect of the invention, the game is played by first providing a three-dimensional game board having a right regular square pyramidal shape, with four stepped sides and a flat top forming multiple levels of different heights, the highest level being the flat top. The levels are divided into a plurality of identifiable playing spaces of alternating colors. Each player is provided with a distinguishable set of playing pieces which preferably has selected playing pieces of the conventional chess game, at least one catapult playing piece, and at least one mace playing piece. The playing pieces of each player are placed at predetermined locations, including placing each of the catapult pieces at a corner playing space on the lowest level of the board. After the game begins, each player, in turn, moves one of his playing pieces from one playing space on the game board to another according to the movement capabilities assigned to each piece, and captures, during moving, another player's playing pieces according to given capturing rules. Each of the catapult playing pieces is stationary at its respective position for guarding selected playing spaces on the lower level and along a diagonal line of the game board. Any playing piece of another player which is moved to a playing space guarded by the catapult playing piece is removed. The players continue the steps of moving and capturing until one of the players wins the game according to a predetermined winning rule such the checkmate rule or a "king-to-the-top" rule.

Other objects and advantages will become apparent with reference to the following detailed description when taken in conjunction with the drawings, in which:

Figure 1:
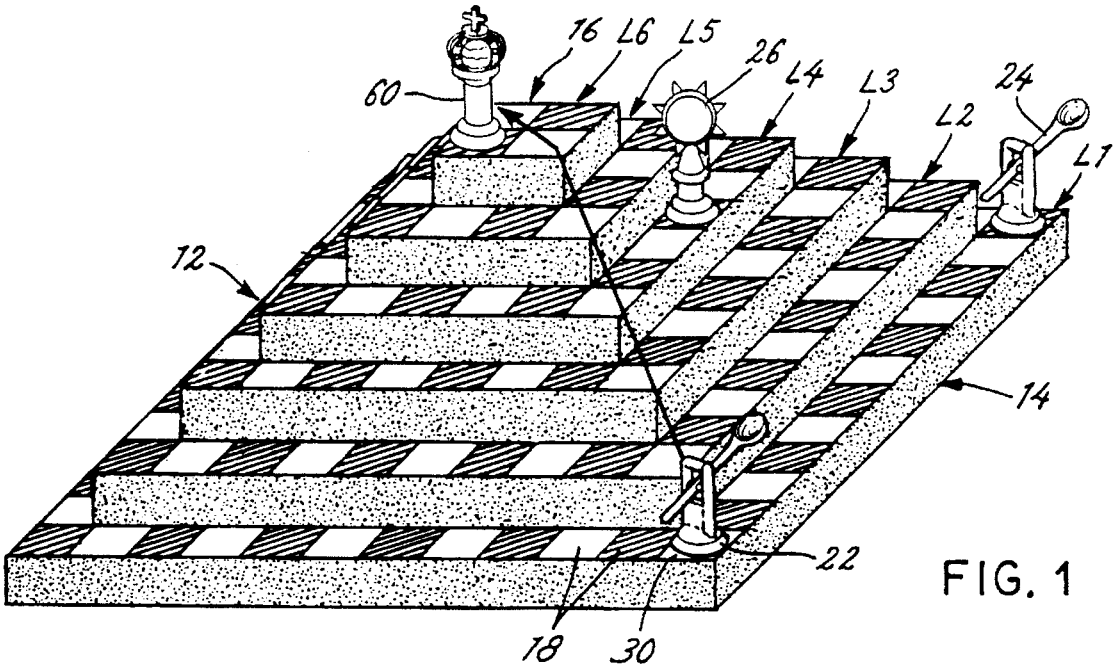
FIG. 1 is a perspective view of an embodiment of the invention utilizing a pyramidal game board and two new types of playing pieces.

While the invention is susceptible of various modifications and alternative constructions, certain illustrated embodiments hereof have been shown in the drawings and will be described below. It should be understood, however, that there is no intention to limit the invention to the specific forms disclosed, but, on the contrary, the invention is to cover all modifications, alternative constructions and equivalents falling within the spirit and scope of the invention as defined by the appended claims.

DETAILED DESCRIPTION OF THE PREFERRED EMBODIMENT

Turing now to the drawings, FIG. 1 shows, in a perspective view, a portion of a chess-type board game apparatus of the present invention, including a game board 12 and several playing pieces. It will be appreciated that the game board 12 is not a two-dimensional flat surface like the conventional chess board, but has an appealing three-dimensional structure. Such three-dimensional structure not only gives the game board an attractive look, but also makes the game more challenging for the players because the players have to take into account the three-dimensional contour of the board when they visualize subsequent moves in their minds. In other words, the players have to think three-dimensionally. Thus, the board 12 imparts distinct three-dimensional characteristics to the game.

As illustrated, the game board 12 has a shape of a right square pyramid, with a square base 14, four stepped-sides, and a flat top 16. The steps and the flat top form a plurality of levels at different heights, with the flat top 16 being the highest level. The game board 12 is divided into a plurality of square playing spaces 18 which are alternatingly colored, preferably in black and white or other high-contrast pairs of colors. In the present embodiment, the pyramidal board has six levels, denoted as L1, L2, L3, L4, L5, L6, with L1 being the lowest level and L6 the highest. Each level is in the shape of a square, and each side of a square has one row of playing spaces. The lowest level L1 has twelve playing spaces along each side, and the number of playing spaces per side reduces as the height of the level increases until the flat top 16 is reached, which has two playing spaces on each side.

Figure 2:
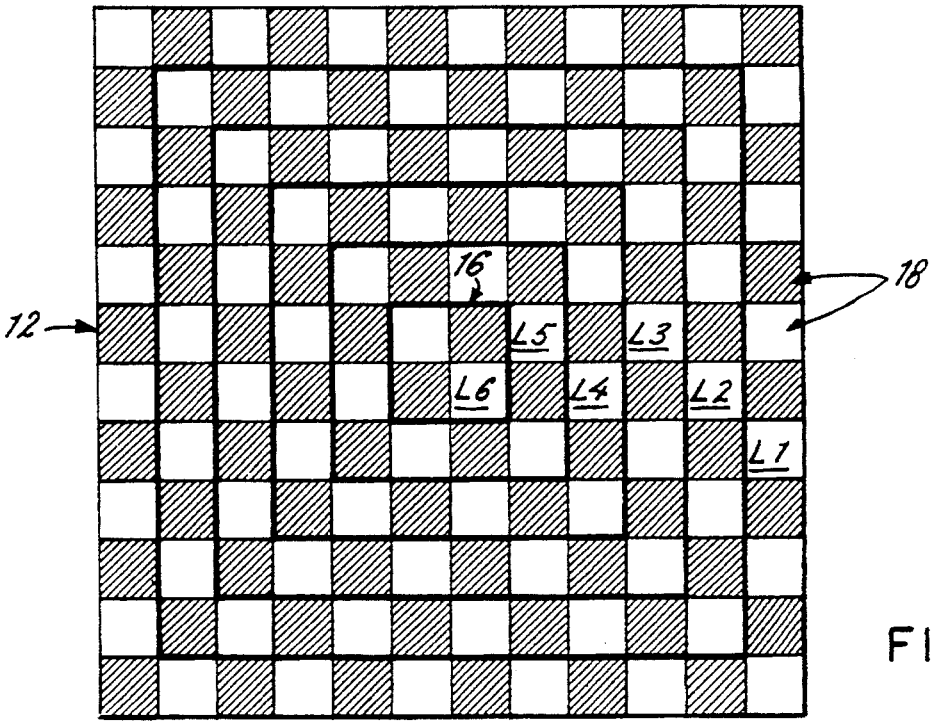
FIG. 2 is a plan view of the pyramidal game board.

FIG. 2 shows a top view of the game board 12. As illustrated, the vertical projection of the game board 12 resembles a board of the conventional chess game, but with increased numbers of ranks and files. More particularly, the playing spaces 18 of the board 12 in vertical projection form a square matrix having twelve rank rows and twelve file rows. Also can be best seen in this view, the levels L1–L6 form concentric squares, with one row of playing spaces along each side of the squares.

The three-dimensional game board may be made of many different materials, depending on the demands of the customers. For example, if it is intended to keep the cost of the game apparatus low in order to promote the popularity of the game, the game board may be formed of molded plastic. Alternatively, for customers who desire durability, appearance, and value of the game apparatus, the game board may be made of metal, such as brass or pewter, or of high quality wood. The game, of course, can also be played by players connected by a computer network, and in such a case the game board may be a computer generated image on the computer screens of the players.

As an improvement of the conventional chess game, the game apparatus of the present invention utilizes the playing pieces of the conventional chess game, and the conventional rules governing their movement and capturing capabilities are substantially retained, except for certain minor changes to the rules for the pawns which will be described in greater detail below. To explain further, the set of playing pieces for each player preferably includes at least the full set of conventional playing pieces. Thus, in the preferred embodiment, each player has at least one king, one queen, two bishops, two knights, two rooks, and eight or more pawns depending on the number of players playing the game. Generally, except for the pawns, each of these conventional playing pieces moves and captures on the three-dimension board 12 according to the conventional rules as if the board were a flat, two-dimensional board like the vertical projection shown in FIG. 2. Thus, the three-dimensional contour of the pyramidal board 12 does not hinder the maneuverability of the playing pieces.

In accordance with a further feature of the present invention, the game apparatus of the present invention takes advantage of the three-dimensional structure of the board 12 to make the game more challenging and fun to play by providing two new types of playing pieces, the rules governing which are designed to enhance the three-dimensional look and feel of the game. One type of the new pieces is termed "catapult." The other new type is termed "mace." For illustration purposes, two catapult playing pieces 22, 24 and a mace playing piece 26 of the present embodiment are shown in FIG. 1. As will be described in greater detail below, a catapult piece is a stationary piece which is to be places at a corner playing space on the lowest level L1 of the board 12 for guarding selected playing spaces within its "shooting range." A mace playing piece, on the other hand, is a mobile piece for movement between adjacent levels and on the same level.

In accordance with another important feature of the present invention, two, three or four players may participate in the game of the present invention at the same time. The sets of playing pieces are preferably distinguishable by their colors, as is conventional for chess-type games. The different colors may be, for example, black, white, red, and green. To facilitate the description of the rules of the game of the present invention, the corresponding letters for the playing pieces are provided in Table 1 below:

TABLE 1

| PLAYING PIECES | BLACK | WHITE | RED | GREEN |
|---|---|---|---|---|
| King | KB | KW | KR | KG |
| Queen | QB | QW | QR | QG |
| Bishop | BB | BW | BR | BG |
| Knight | HB | HW | HR | HG |
| Rook | RB | RW | RR | RG |
| Catapult | CB | CW | CR | CG |
| Mace | MB | MW | MR | MG |
| Pawn | PB | PW | PR | PG |

Figure 3:
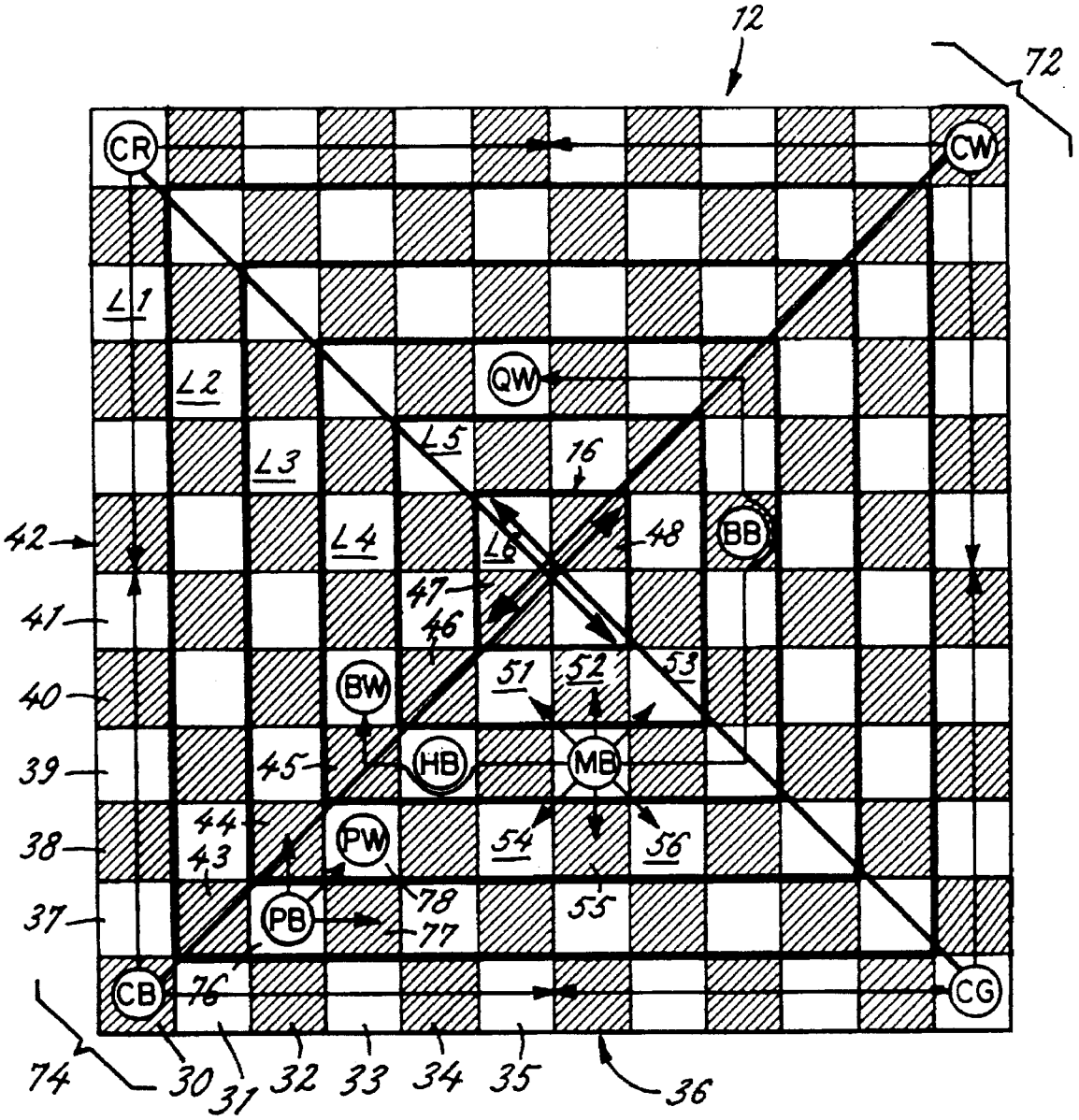
FIG. 3 is a plan view illustrating the movement and functions of the new types of playing pieces.

The rules governing the functions of the catapult playing pieces and the mace playing pieces will now be described with reference to FIG. 3. For simplicity of illustration, FIG. 3 shows the plan view of the board, and the playing pieces are identified by their corresponding letters. Four catapult playing pieces CB, CR, CG, CW, in respectively the colors black, red, green, and-white, are shown in FIG. 3. As briefly described above, the catapult playing pieces are stationary pieces, i.e., they are not allowed to be moved during the game. They may, however, be captured by playing pieces of other players and removed from the board 12. At the inception of the game, each catapult piece is positioned at a corner of the lowest level L1. For example, as illustrated, the black catapult CB is positioned on the corner playing space 30 on the lowest level. Each catapult piece covers half of the playing spaces along each of the two sides of the lowest level L1 that flank the corner in which it is located. Thus, in FIG. 3, the black catapult CB guards five playing spaces 31–35 along the side 36, and five playing spaces 37–41 along the side 42. Each catapult piece further guards several playing spaces along a diagonal line of the board 12. The range of the catapult piece along the diagonal line extends over the flat top 16 (the highest level L6) of the pyramidal board. Thus, in the illustrated embodiment, the black catapult CB covers six playing squares 43–48 along the diagonal direction. The playing spaces guarded by a catapult piece may be occupied by other playing pieces of the same player. However, if a playing piece of an opponent is moved onto any of the guarded playing spaces, that piece will be deemed eliminated and removed from the board, and such removal is automatic in that it does not constitute a turn by the player who owns the catapult playing piece.

In contrast to the stationary catapult pieces, the mace playing pieces are powered to ascend and descend the levels L1–L6 of the board 12, and to move between playing squares on the same level. For simplicity of illustration, FIG. 3 shows only a black mace MB. As illustrated, the mace piece MB is currently on the fourth level L4. During a turn, a mace piece may move to an adjacent playing square on an adjacent level. Thus, the black mace MB is powered to move to the playing squares 51–53 on the fifth level L5, or to the playing squares 54–56 on the third level L3.

What distinguishes the mace playing piece from other playing pieces is its ability to move on its present level. On a given level, a mace piece is powered to move any number of playing spaces on the same level to a playing space not occupied by a playing piece of the same set, unless it is stopped by a playing piece of an opponent. In that case, the opponent's piece is deemed captured and removed, and the mace piece occupies the playing space of the captured piece. When moving on the same level, a mace may jump over other playing pieces of the same set. For example, as illustrated in FIG. 3, the black mace MB may jump over the black knight HB to capture the white bishop BW, or, alternatively, to jump over the black bishop BB to capture the white queen QW.

Figure 4:
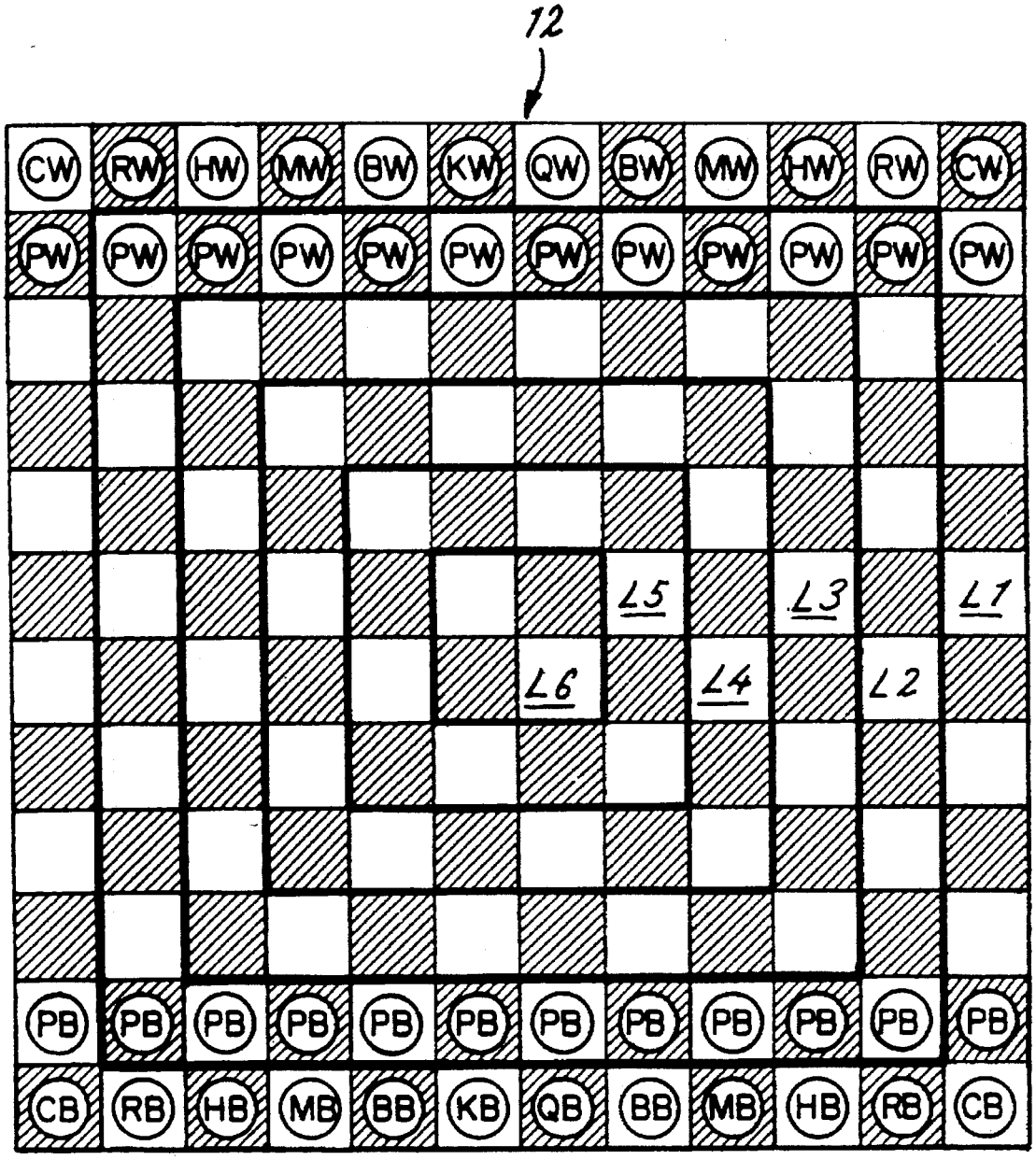
FIG. 4 is a plan view illustrating the starting setup of a game for two players.

The starting positions of the playing pieces in a game of the present invention for two players is shown in FIG. 4. Again, for simplicity of illustration, FIG. 4 shows the plan view of the board 12, and the playing pieces on the board are identified by their corresponding letters as listed in Table 1. As illustrated, each player in this two-player setup has the full set of playing pieces of the conventional chess game, plus four additional pawns, two maces and two catapults. All of the pawn playing pieces are positioned on the second level L2, and the rest of the playing pieces are positioned on the lowest level L1. The two sets of playing pieces are positioned on opposite sides of the game board 12. Generally, after the game begins, like the conventional chess game, each player in turn moves one of his playing pieces from one playing space on the pyramidal board to another according to the movement capabilities assigned to that playing piece. If the playing piece is moved to a playing space occupied by the opponent's playing piece, then the opponent's piece is deemed as being captured and removed from the board. In the two player game, each of the traditional playing pieces moves or captures according the rules of the traditional chess game as if the board 12 were a flat surface. The new pieces, namely the mace pieces and the catapult pieces, function in the manner described above.

In the two-player game as illustrated in FIG. 4, there are two options to win the game. The first one is to checkmate the opponent, as in the conventional chess game. The second option applies the "king-to-the-top" rule, which means that the player who is the first to move his king playing piece to the flat top 16 of the pyramidal game board 12 wins the game.

It will be appreciated that the king-to-the-top game is made significantly challenging by the use of the catapult pieces. As described above, each catapult piece guards two diagonally opposed squares on the flat top 16 of the pyramid, and at the inception of the game the entire flat top is covered by the two catapults of each player. As illustrated in FIG. 1, the flat top level L6 is guarded by the two catapult pieces 22, 24. Thus, in order to be able to move the king 60 to the top 16, as illustrated in FIG. 1, the player has to capture and remove at least one of the catapults of the opponent.

Figure 5:
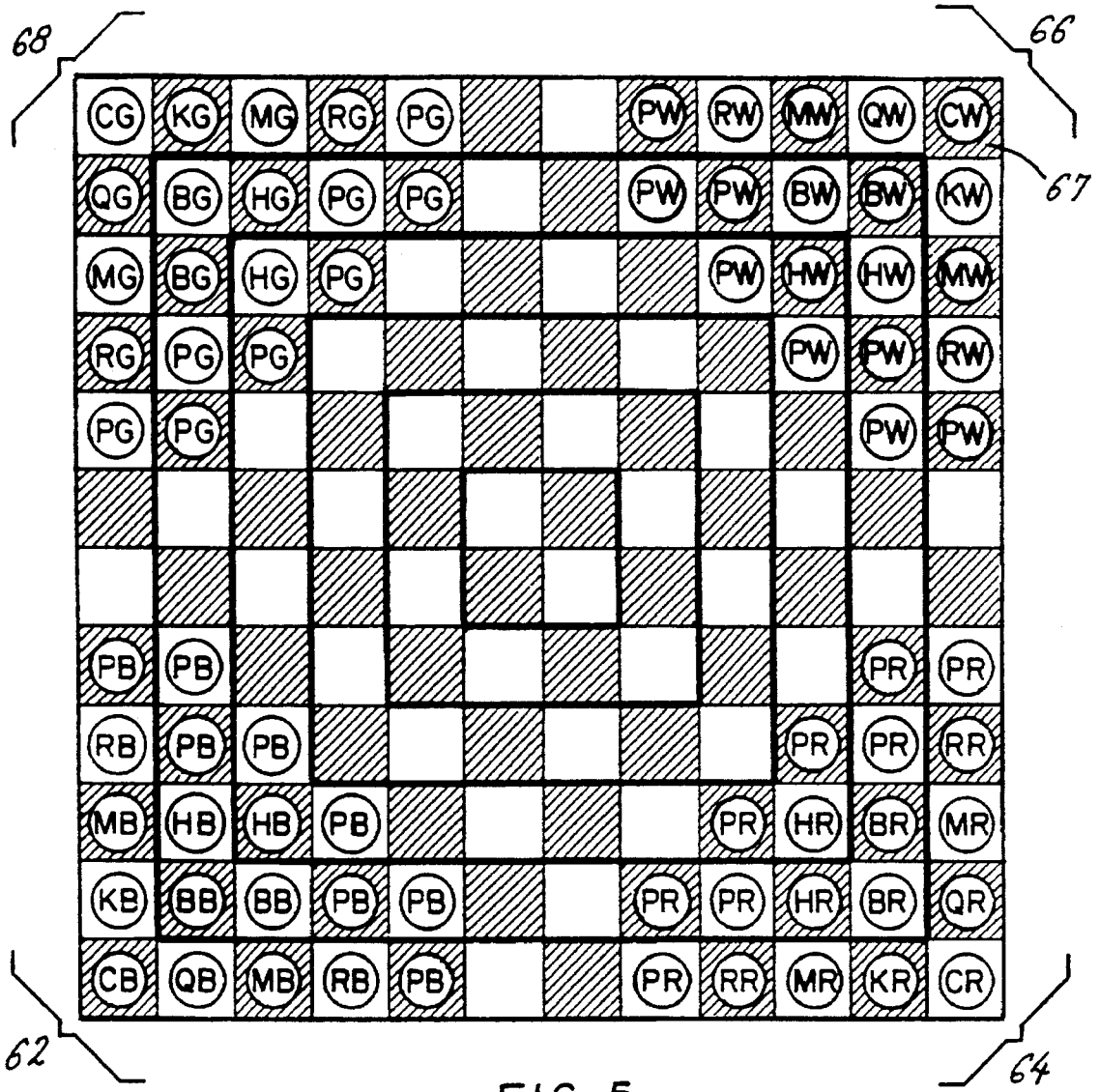
FIG. 5 is a plan view illustrating the starting setup of a game for fours players.

It is an important feature of the present invention that three or four players may play the chess-type game of the present invention at a time. FIG. 5 shows the starting positions of the playing pieces for the four-player game. In the illustrated setup, four sets 62, 64, 66, 68 of playing pieces of distinguishable colors: black, red, white, and green, are used. The type and color of each playing piece is identified by the corresponding letters as listed in table 1. As illustrated, the playing pieces in the set of each player include the full set of the conventional chess game, with the addition of two mace pieces and one catapult piece. As in the two-player game described above, the catapult of each player is positioned on the lowest level L1 of the corner occupied by the player, and covers the selected playing spaces as described above in conjunction with FIG. 3.

Instead of playing the game as four independent players, the players may also form two teams, with the players of each team occupying two adjacent corners in the starting setup of the game. For example, the player, with the black set 62 and the player with the white set may form a team, while the other two players forming a team.

Figure 6:
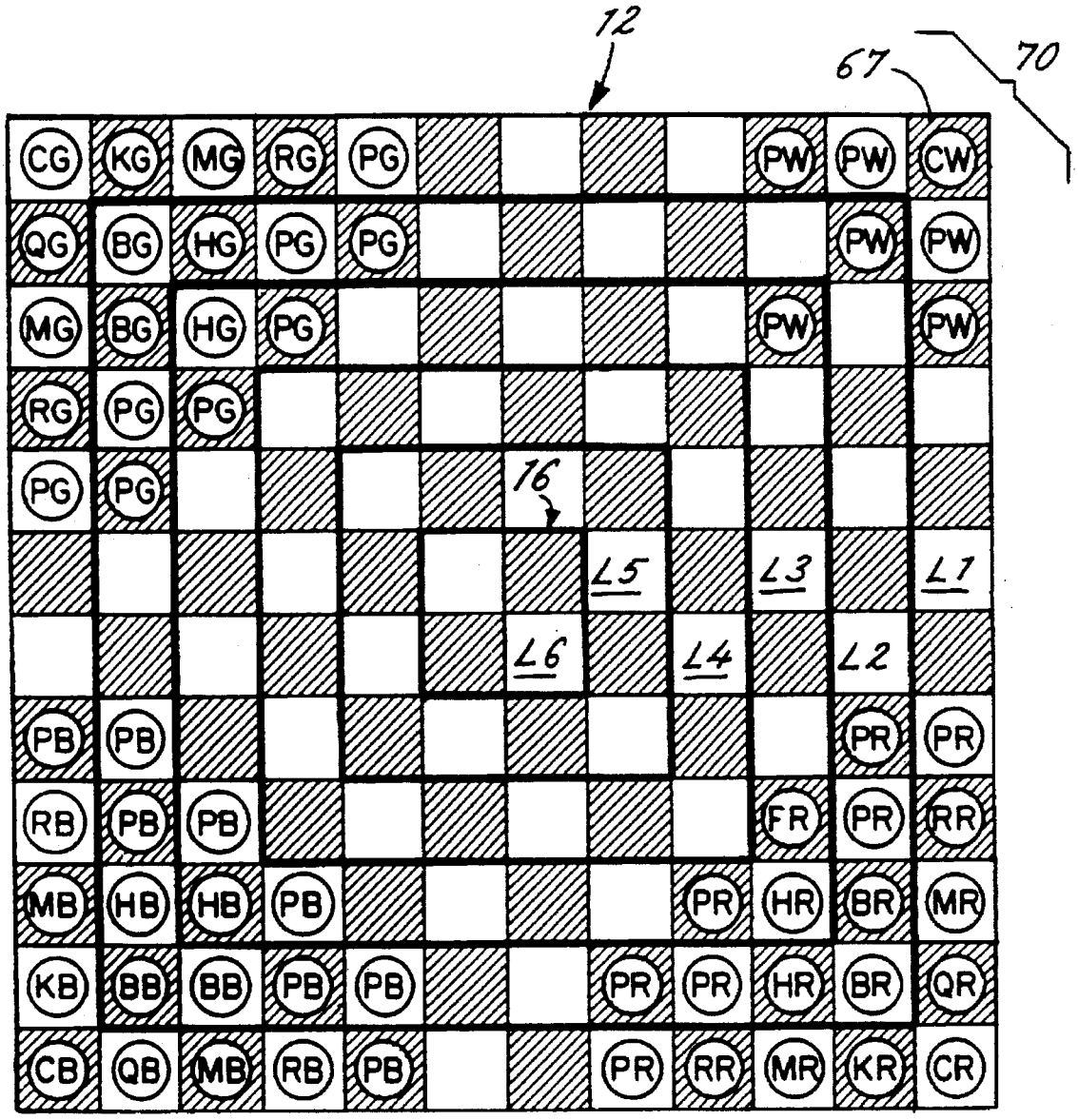
FIG. 6 is a plan view illustrating the starting setup of a game for three players.

The starting setup for the three-player game is shown in FIG. 6. In the three-player game, each player has the same playing pieces as he would have in a four-player game described above, and the pieces are positioned in the same manner in the corner of the board 12 occupied by the player. In order to provide a balanced starting point for the players, a dummy setup 70 is placed in the corner not occupied by the three players. In the illustrated starting setup, the dummy setup includes a white army comprising six pawns PW and a catapult CW. Like other catapult pieces, the white catapult CW is positioned at a corner playing space 67 on the lowest level L1 of the board, and guards selected playing spaces according to the rules described above. Any playing piece that is moved to the playing spaces covered by the white catapult CW is automatically removed. Thus, the flat top 16 of the pyramidal board 12 is guarded by all four catapult pieces at the corners of the board.

All of the pieces in the dummy setup 70 are stationary in that no player is allowed to move them. The dummy pieces may be captured by any player, however. Although the dummy army is stationary, it is not defenseless because for strategic reasons the players may want to protect the catapult of the dummy army from being captured by another player. Such dynamics contributes to the fun and excitement of the game.

In the three-player, four-player, or double-team games, a player wins by being the first to move his king to the flat top 16 of the pyramidal board 12. The conventional checkmate rule is not used because there are more than two players in the game.

If a player is about to move his king into check by an opponent's piece, that opponent must warn him so as to avoid the checkmate situation. Should a player's king be put into a stalemate position, his king become ineffective and may not be moved. The player will stay in the stalemate position until his king is freed by himself or another player or until the piece that holds him in stalemate is moved.

Also due to the increased number of players, the rules governing the movement of pawns in a game with three or more players is different from the rules of the conventional chess game. The permitted movement of a pawn is illustrated in FIG. 3. As illustrated, the black pawn PW is allowed to move "forward" to an adjacent playing space in any direction. The meaning of the term "forward" as used here is different from that in conventional chess game, and is intended to cover any motion that moves the pawn PB closer to the corner 72 opposite to the corner 74 of the player who owns the pawn. For example, as illustrated, the black pawn PB at the playing space 76 is allowed to move forward to the playing spaces 44, 77, 78, but may not move to other playing spaces. A pawn is allowed to capture only those pieces that are diagonally in front of it. For example, the black pawn PB is only allowed to capture an opponent's piece, such as the white pawn PW, on the playing space 78.

The game of this invention is preferably played on the three-dimensional pyramidal board as illustrated in FIG. 1. It is possible, however, to play the game on a flat (two-dimensional) board, although in that case the three-dimensional look and feel of the game will be missed. The flat board for playing the game generally resembles the plan view of the pyramid board in FIG. 2. Thus, the flat board has a twelve-by-twelve matrix of playing spaces divided into concentric squares, each square corresponding to one level of the pyramidal board 12. In view of the foregoing disclosure, the manner in which the game is played on the flat board should be clear. The utilization of a flat board in the game does not deviate from the scope and spirit of the present invention.

It will be appreciated now that what has been provided is an improved chess-type board game which uses an attractive three-dimensional game board with a square pyramid shape, and two new types of playing pieces. The novel combination of the pyramidal game board and the new playing pieces significantly increases the fun and challenge of playing the game. The game can be played by two, three, or four players.

What is claimed is:

1. A method of playing a chess-type game by a plurality of players, comprising the steps of:

providing a three-dimensional game board having a right regular square pyramidal shape with four stepped sides and a flat top forming multiple levels of different heights including a lowest level and a highest level, the highest level being the flat top, the levels being divided into a plurality of identifiable playing spaces of alternating colors;

providing each player with a distinguishable set of playing pieces having selected playing pieces of the conventional chess game and at least one catapult playing piece;

placing the playing pieces of each player at predetermined locations, including placing each of the catapult pieces at a playing space at a corner of the lowest level;

each player, in turn, moving one of his playing pieces from one playing space on the game board to another according to movement capabilities assigned to each piece, each of the catapult playing pieces being stationary at its respective position for guarding selected playing spaces on the lower level and along a diagonal line of the game board;

capturing, during moving, another player's playing pieces according to given capturing rules;

removing any playing piece of another player which is moved to a playing space guarded by the catapult playing piece;

continuing the steps of moving and capturing until one of the players wins the game according to a predetermined winning rule.

2. A method as in claim 1, wherein the step of providing sets of playing pieces includes providing at least one mace playing piece for each set, and the step of moving includes moving a mace playing piece selectively to an adjacent playing square on an adjacent level and to a playing square on a present level without being blocked by other playing pieces of the player.

3. A method as in claim 1, wherein the game is for two players, and wherein a player who checkmates a king playing piece of the other player wins the game.

4. A method as in claim 1, wherein a player who is the first to move a king playing piece of his set to the highest level of the game board wins the game.

5. A method as in claim 1, wherein the game is for at least three players, and the step of placing places the set of playing pieces of each player in a corresponding corner region of the game board.

6. A method as in claim 5, wherein the game is for three players, and wherein the method includes providing a dummy set of playing pieces including one dummy catapult piece, and placing the dummy set in a corner region not occupied by the sets of the players, including placing the dummy catapult playing piece at a corner playing space on the lowest level.

7. The method as in claim 5, wherein a player who is the first to move a king playing piece of his set to the highest level of the game board wins the game.

8. The method as in claim 1, wherein the playing spaces in vertical projection form a square matrix having twelve file rows and twelve rank rows.

* * * * *